US006508291B2

(12) United States Patent
Schniggendiller

(10) Patent No.: US 6,508,291 B2
(45) Date of Patent: Jan. 21, 2003

(54) JOINT ARM AWNING WITH COVER, IN PARTICULAR BOX-MOUNTED AWNING

(75) Inventor: Luise Schniggendiller, Münster (DE)

(73) Assignee: Schmitz-Werke GmbH & Co., Emsdatlen (DE)

( * ) Notice: Subject to any disclaimer, the term of this patent is extended or adjusted under 35 U.S.C. 154(b) by 23 days.

(21) Appl. No.: 09/761,665

(22) Filed: Jan. 18, 2001

(65) Prior Publication Data

US 2002/0092551 A1 Jul. 18, 2002

(30) Foreign Application Priority Data

Jan. 18, 2000 (DE) ..... 100 01 756

(51) Int. Cl.[7] ..... E04F 10/06
(52) U.S. Cl. ..... 160/22; 160/44; 135/88.11
(58) Field of Search ..... 135/88.11, 88.12; 160/22, 68, 70, 44, 66

(56) References Cited

U.S. PATENT DOCUMENTS 4,469,159 A * 9/1984 Lohausen ..... 160/22
4,566,516 A * 1/1986 Lohausen ..... 160/22
4,673,017 A * 6/1987 Lauzier ..... 160/22
5,121,782 A * 6/1992 Renkhoff ..... 160/22
5,437,322 A * 8/1995 Murray ..... 160/61
5,492,162 A * 2/1996 Lohausen ..... 160/22
5,673,739 A * 10/1997 Brutsaert ..... 160/22
5,839,491 A * 11/1998 Kroner ..... 160/22
5,924,466 A * 7/1999 Kroner ..... 160/22
6,024,152 A * 2/2000 Rosenich ..... 160/22

FOREIGN PATENT DOCUMENTS

DE 85 35 976 4/1986
DE 90 13 856 1/1991
DE 297 02 529 * 4/1997

* cited by examiner

*Primary Examiner*—Janet M. Wilkens
(74) *Attorney, Agent, or Firm*—Browdy and Neimark

(57) ABSTRACT

In a joint arm awning with a cover, in particular a box-mounted awning, comprising a fabric roll shaft for the among fabric to be rolled up and a drop-out section which is joined to free ends of extendible joint arms and inside of which the free outer edge of the awning fabric is fixed, it is provided that a first gutter is formed along the outer edge of the awning fabric inside the drop-out section; and that an upwardly open second gutter is formed in the vicinity of the upper edge of the drop-out section; and that water can flow from the upper gutter into the lower gutter.

5 Claims, 1 Drawing Sheet

JOINT ARM AWNING WITH COVER, IN PARTICULAR BOX-MOUNTED AWNING

BACKGROUND OF THE INVENTION

1. Field of the Invention

The invention relates to a joint arm awning with a cover, in particular a box-mounted awning, comprising a fabric roll shaft for the fabric to be rolled up and a drop-out section which is joined to the free ends of extendible joint arms and inside of which the free outer edge of the awning fabric is fixed.

2. Background Art

Awnings of the generic type are faced with the problem of defined drainage of rainwater in the retracted as well as in the extended state. If the rainwater is not successfully drained off, soils on a wall of a house will result from water flowing down along the wall. The idea is that the water will not simply flow down from tie end portion of the awning fabric, but is drained off laterally.

SUMMARY OF THE INVENTION

It is an object of the invention to embody an awning of the type mentioned at the outset such that draining off rainwater is optimized as opposed to conventional constructions.

Draining off water that flows along the wall of a house by means of a sealing lip has been known per se; the water flows along the awning box and finally falls down from the drop-out section. The drop-out section becomes soiled and unsightly streaks of dirt will be the result.

According to the invention, this object is attained in that a first gutter is provided along the outer edge of the awning fabric inside the drop-out section; in that a second gutter which is open upwards is formed in the vicinity of the upper edge of the drop-out section; and in that the water can flow from the upper gutter into the lower gutter.

This design ensures that any water which drops from above on the extended awning fabric is drained off laterally inside the drop-out section and that the water which flows down from the cover when the drop-out section is retracted is collected by the open upper gutter.

As a result of the design according to the invention, any contact of water flowing along the wall of a house with the drop-out section is precluded when the awning is retracted, and streaks of dirt are reliably avoided.

For lateral drainage of the rainwater it is provided that the lower gutter comprises a drain-off extension piece which projects laterally outwards.

By advantage, the lower gutter is parallel to, and directly adjoins, a piping groove and a piping on the outer edge of the awning fabric, with a transitional section being advantageously formed between the piping groove and the lower gutter for draining water to be led directly into the gutter.

A sealing section curved arcuately upwards may be provided in the portion between the rear edge of the cover and the wall, avoiding any penetration of water in this portion.

Details of the invention will become apparent from the ensuing description of a preferred exemplary embodiment, taken in conjunction with the drawing.

DESCRIPTION OF THE PREFERRED EMBODIMENT

Figure 1:
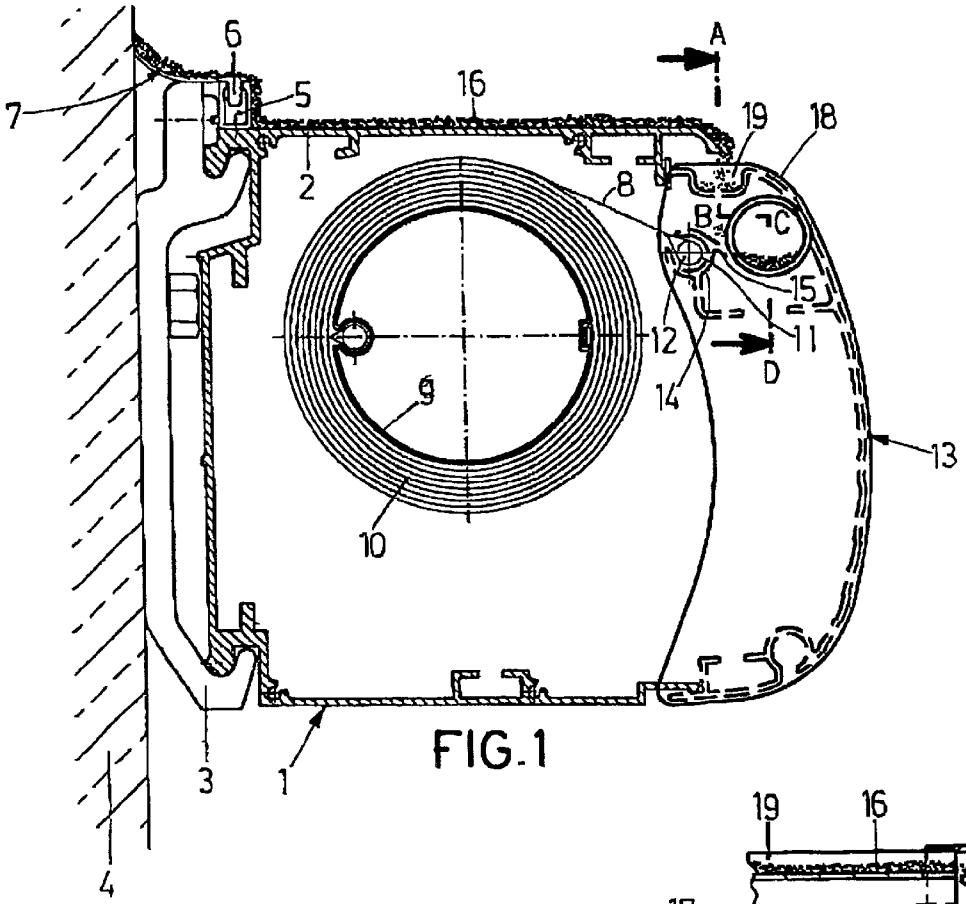
FIG. 1 is a sectional view of a joint arm awning according to the invention in the retracted state.
Figure 2:
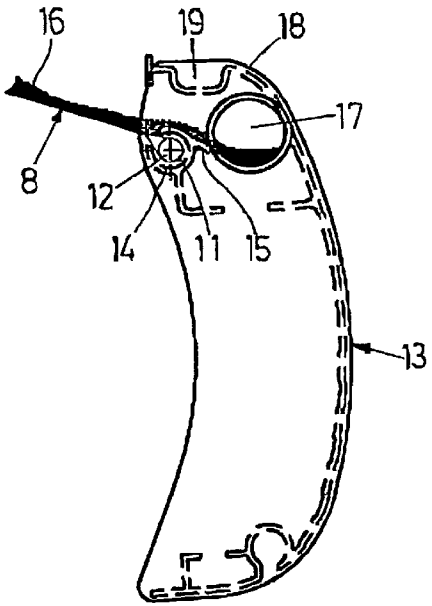
FIG. 2 is a sectional view of the drop-out section in the extended state.

An awning seen in the drawing comprises a box 1 with an upper cover 2, which is fixed on the wall 4 by the aid of brackets 3. Inserted in a groove 5 on the upper side of the cover 2 is an extension piece 6 of a sealing section 7, which is curved slightly arcuately upwards, bearing against the wall 4, and which drains off toward the cover 2 any rainwater that flows on the wall 4 so that the water is prevented from running along the portion of the brackets 3.

An awning fabric 8 is rolled up on a fabric roil shaft 9, forming a fabric roll 10, and a piping 12 is sewn on the free outer edge 11 of the awning fabric 8.

A drop-out section 13 is articulated to the outer ends of joint arms (not shown in the drawing), the inner ends of which are joined to a support pipe (not shown). The drop-out section 13 has a piping groove 14, in which the piping 12 of the awning fabric 8 is fixed.

The piping groove 14 is followed by a transitional section 15 which, when the drop-out section 13 is extended, will lead water 16 that drops on the upper side of the awning fabric into an interior gutter 17 of tubular cross-sectional shape.

Provided on the upper side 18 of the drop-out section 13 is an upwardly open second gutter 19 which (see FIG. 1) collects water 16 that drains off the upper side of the cover 2 when the drop-out section 13 is retracted.

Figure 3:
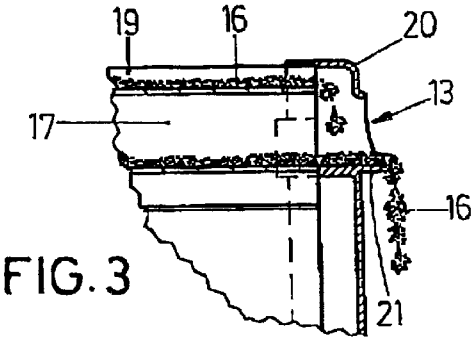
FIG. 3 is a sectional view along the line A-B-C-D of FIG. 1.

FIG. 3 illustrates that the outer end portion 20 of the drop-out profile 13 is designed for the water 16 which drains off the upper gutter 19 to be collected in the area of the lower gutter 17, where it drains off downwards to the side of the drop-out section 13 together with the water 16 in the lower gutter 17 by way of a laterally projecting drain-off extension piece 21.

What is claimed is:

1. A joint arm awning with a cover (2), comprising a fabric roll shaft (9) for an awning fabric (8) to be rolled up and a drop-out section (13), extendable out from the fabric roll shaft (9) and inside of which a free outer edge (11) of the awning fabric (8) is fixed, wherein a lower gutter (17) is provided along the outer edge (11) of the awning fabric (8) inside the drop-out section (13);

wherein an upwardly open second gutter (19) is formed proximate to the upper edge (18) of the drop-out section (13); and wherein water (16) can flow from the upper gutter (19) into the lower gutter (17).

2. A joint arm awning according to claim 1, wherein the lower gutter (17) comprises at least a drain-off extension piece (21) which projects outwards laterally.

3. A joint arm awning according to claim 1, wherein the lower gutter (17) is parallel to, and directly engages, a piping groove (14) within which a piping (12) on the outer edge (11) of the awning fabric (8) is fixed.

4. A joint arm awning according to claim 3, wherein a transitional section (15) is provided between the piping groove (14) and the lower gutter (17).

5. A joint arm awning according to claim 1, wherein a sealing section (7) which is curved upwards is provided in a portion between a rear edge of the cover (2) and a wall (4) supporting the awning.

* * * * *